US006776080B2

(12) United States Patent
Hansen et al.

(10) Patent No.: US 6,776,080 B2
(45) Date of Patent: Aug. 17, 2004

(54) HYDRAULIC PRESSURE INTENSIFIER

(75) Inventors: Leif Hansen, Sønderborg (DK); Peter J. M. Clausen, Nordborg (DK); Christen Esperson, Augustenborg (DK); Jan Petersen, Egernsung (DK)

(73) Assignee: miniBooster Hydraulics A/S, Sønderborg (DK)

( * ) Notice: Subject to any disclaimer, the term of this patent is extended or adjusted under 35 U.S.C. 154(b) by 69 days.

(21) Appl. No.: 10/305,324

(22) Filed: Nov. 26, 2002

(65) Prior Publication Data

US 2003/0097924 A1 May 29, 2003

(30) Foreign Application Priority Data

Nov. 28, 2001 (DE) ..... 101 58 178

(51) Int. Cl.[7] ..... F01L 25/04
(52) U.S. Cl. ..... 91/300; 91/297; 91/319
(58) Field of Search ..... 91/299, 282, 290, 91/297, 300, 319

(56) References Cited

U.S. PATENT DOCUMENTS 4,555,220 A 11/1985 Hall et al.
4,706,546 A 11/1987 Inoue et al.
5,170,691 A * 12/1992 Baatrup ..... 91/319
5,868,122 A 2/1999 Gram et al.
6,295,914 B1 10/2001 Iversen
2002/0029569 A1 3/2002 Nomura et al.

FOREIGN PATENT DOCUMENTS

DE 196 33 258 C1 8/1997

* cited by examiner

*Primary Examiner*—Edward K. Look
*Assistant Examiner*—Michael Leslie
(74) *Attorney, Agent, or Firm*—Friedrich Kueffner

(57) ABSTRACT

A hydraulic pressure intensifier includes a supply connection, a return connection, and a high-pressure connection. An intensifier piston assembly includes a high-pressure cylinder with a high-pressure piston displaceable therein and a low-pressure cylinder having a greater cross-section than the high-pressure cylinder, with a low-pressure piston which is displaceable therein. The low-pressure piston is connected to the high-pressure piston and divides the low-pressure cylinder into a first low-pressure chamber on the side of the high-pressure piston and a second low-pressure chamber. A switching valve acts on the second low-pressure chamber with pressure from a pressure source or relieves it of pressure. The switching valve includes a valve element which in one direction of movement is subjected to a pressure in a first control pressure chamber with a smaller pressure application area and in the opposite direction of movement is subjected to a pressure in a second control pressure chamber with a larger pressure application area. The pressure in the second control pressure chamber is controlled by the low-pressure piston.

11 Claims, 2 Drawing Sheets

HYDRAULIC PRESSURE INTENSIFIER

BACKGROUND OF THE INVENTION

1. Field of the Invention

The present invention relates to a hydraulic pressure intensifier with a supply connection, a return connection, a high-pressure connection, an intensifier piston assembly including a high-pressure cylinder with a high-pressure piston displaceable therein and a low-pressure cylinder having a greater cross-section than the high-pressure cylinder, with a low-pressure piston which is displaceable in the low-pressure cylinder and is connected to the high-pressure piston and divides the low-pressure cylinder into a first low-pressure chamber on the side of the high-pressure piston and a second low-pressure chamber, and with a switching valve which either acts on the second low-pressure chamber with pressure from a pressure source or relieves it of pressure, wherein the switching valve includes a valve element which in one direction of movement is subjected to a pressure in a first control pressure chamber with a smaller pressure application area and in the opposite direction of movement is subjected to a pressure in a second control pressure chamber with a larger pressure application area.

2. Description of the Related Art

A hydraulic pressure intensifier of this kind is known from DE 196 33 258 C1.

The high-pressure cylinder is supplied with fluid from the supply connection via a first non-return valve when the high-pressure piston moves in a direction which increases the volume of the high-pressure cylinder. Upon a decrease in volume of the high-pressure cylinder, this fluid is then discharged via a second non-return valve to the high-pressure connection. The movement of the high-pressure piston is controlled by the movement of the low-pressure piston. The low-pressure piston is subjected to pressure from the supply connection on its side facing away from the high-pressure piston when the volume of the high-pressure cylinder is to decrease. When the volume of the high-pressure cylinder is to increase, this takes place under the pressure of the fluid flowing into the high-pressure cylinder. In the process, the fluid located in the second low-pressure chamber of the low-pressure cylinder is displaced partly to the return connection and partly into the first low-pressure chamber. For this purpose, the second low-pressure chamber is rendered pressureless. Switching of pressurization of the two low-pressure chambers of the low-pressure cylinder is effected via a switching valve with a valve element which is constructed as a valve slide. One end face of the valve element is subjected to the pressure in a control pressure chamber, wherein this pressure corresponds to the pressure at the supply connection. This first control pressure chamber acts with a smaller pressure application area on the valve element than the pressure in a second control pressure chamber on the opposite side of the valve element. This pressure changes. In the known case it is controlled by the movement of the high-pressure cylinder. As the pressure in the second control pressure chamber acts via a larger pressure application area on the valve element, the valve element is subjected to the changing pressures in the second control pressure chamber in such a way that it can be moved to and fro in the correct position.

This design functions to a large extent satisfactorily. However, it presupposes that the fluid which is to be raised to a higher pressure is identical with the fluid which is used for "driving". Separation of the two fluids is not possible.

SUMMARY OF THE INVENTION

It is the primary object of the present invention to provide a pressure intensifier in which the driving fluid can be different from the pumped fluid.

In accordance with the present invention, this object is met in a hydraulic pressure intensifier of the kind described above by the fact that the pressure in the second control pressure chamber is controlled by the low-pressure piston.

Thus, the high-pressure piston is used as a "sealing zone" between two fluid zones which accordingly can admit different fluids. Naturally, it is also possible to drive the pressure intensifier with the same fluid which is also to be pumped. The possible applications have however been extended appreciably when pressure in the second control pressure chamber is controlled by the low-pressure piston. The characteristic of the control pressure chambers being arranged on opposite sides of the valve element in the direction of movement is to be understood functionally here. The valve element is controlled or moved by the pressure in one control pressure chamber into one switching position and by the pressure in the other control pressure chamber into another switching position. How this is effected in detail depends on the design of the valve element, e.g. whether it is constructed in one or more parts.

Preferably, the second control pressure chamber is connected to a pilot line comprising two branches which at two positions axially remote from each other open out into the circumferential wall of the low-pressure cylinder. Of the two branches, one ensures that the second control pressure chamber is subjected to an elevated pressure, for example, the pressure at the supply connection, while the other branch is used to relieve the second control pressure chamber of pressure. Control is here effected exclusively by the low-pressure piston which, depending on the position, alternately either closes or clears the openings of the two branches.

Preferably, the low-pressure piston includes an auxiliary channel which in one position of the low-pressure piston comes into alignment with the opening of one branch and in another position of the low-pressure piston comes into alignment with the opening of the other branch. Preferably, the two positions are the end positions of the low-pressure piston, i.e. the positions in which the high-pressure cylinder has its greatest or its smallest volume. Due to the fact that it is not the end edge of the low-pressure piston, but an auxiliary channel located in or on the low-pressure piston that is used for pressure control, it is no longer required to use the pressures in the first or second low-pressure chamber to switch the valve element of the switching valve assembly. This facilitates control of the switching valve very considerably.

Preferably, the auxiliary channel is formed by a circumferential groove on the low-pressure piston. The circumferential groove can be made easily. It does not lead to significant weakening of the low-pressure piston. Above all, it is favorable that angular adjustment of the low-pressure piston is no longer required. The low-pressure piston in practically any rotational position is capable of making a connection between the openings of the two branches and the auxiliary channel.

Preferably, a supply channel connected to the supply connection opens out at the same axial position as the opening of the first branch, and a return channel connected to the return connection opens out at the same axial position as the opening of the second branch. Through the auxiliary channel, therefore, the connections between the second control pressure chamber and the supply connection, on the one hand, and the return connection, on the other hand, can then be made in a relatively simple manner. Pressurization of the second control pressure chamber is then effected only for a short time, i.e. as long as the auxiliary channel, the two branches and the supply channel or return channel come into alignment with each other; but this short time is sufficient to cause the valve element of the switching valve assembly to switch. Thereafter the pressure in the second control pressure chamber is essentially trapped, so that pressure variations in the supply connection or in the return connection can no longer have an effect on the position of the valve element.

Preferably, a stop plug is arranged between the second control pressure chamber and the supply connection. This stop plug or throttle ensures that the pressure in the second control pressure chamber can remain at the pressure of the supply connection even if leaks occur. These leaks, if any, are as a rule so small that the fluid continuing to flow through a stop plug is sufficient for equalization. If, on the other hand, the pressure in the second control pressure chamber has been relieved to be equal to the pressure at the return connection, then the fluid continuing to flow through the stop plug does not lead to a pressure increase in the second control pressure chamber fast enough to be able to displace the valve element.

It is particularly preferred that the stop plug is arranged in a line which can be shut off. The delivery of fluid under pressure into the second control pressure chamber can therefore be prevented if this is not wanted. Conversely, it can be ensured that leaks are equalized if the higher pressure prevails in the control pressure chamber, so that the valve element is reliably held fast in both its positions. Hence the pressures defined by the low-pressure piston in the second control pressure chamber for the respective positions of the valve element are trapped.

Preferably, the line which can be shut off is controlled by the valve element. Thus, external measures are not required and the correct switching state can always be produced automatically when the valve element changes its position. In the position in which the second control pressure chamber has been placed under pressure, a connection of the supply connection to the second control pressure chamber is then made automatically via the stop plug. Conversely, this connection is interrupted when the second control pressure chamber has been rendered pressureless.

It is particularly preferred that the stop plug is arranged in the valve element. This is a relatively simple option for clearing or shutting off the line in which the stop plug is arranged, depending on the position.

Preferably, the stop plug branches off from a channel which, in a position of the valve element caused by the pressure in the second control pressure chamber, connects the supply connection to the second low-pressure chamber. This is a relatively simple embodiment. Alterations to the housing of the switching valve assembly are not necessary. Basically, an additional bore in the valve element is sufficient.

Preferably, the high-pressure connection is connected via a pilot-controlled non-return valve to the return connection. This embodiment is advantageous if the driving fluid is the same as the one which is also to be raised to a higher pressure. One is then able to relieve the high-pressure side of pressure relatively rapidly.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
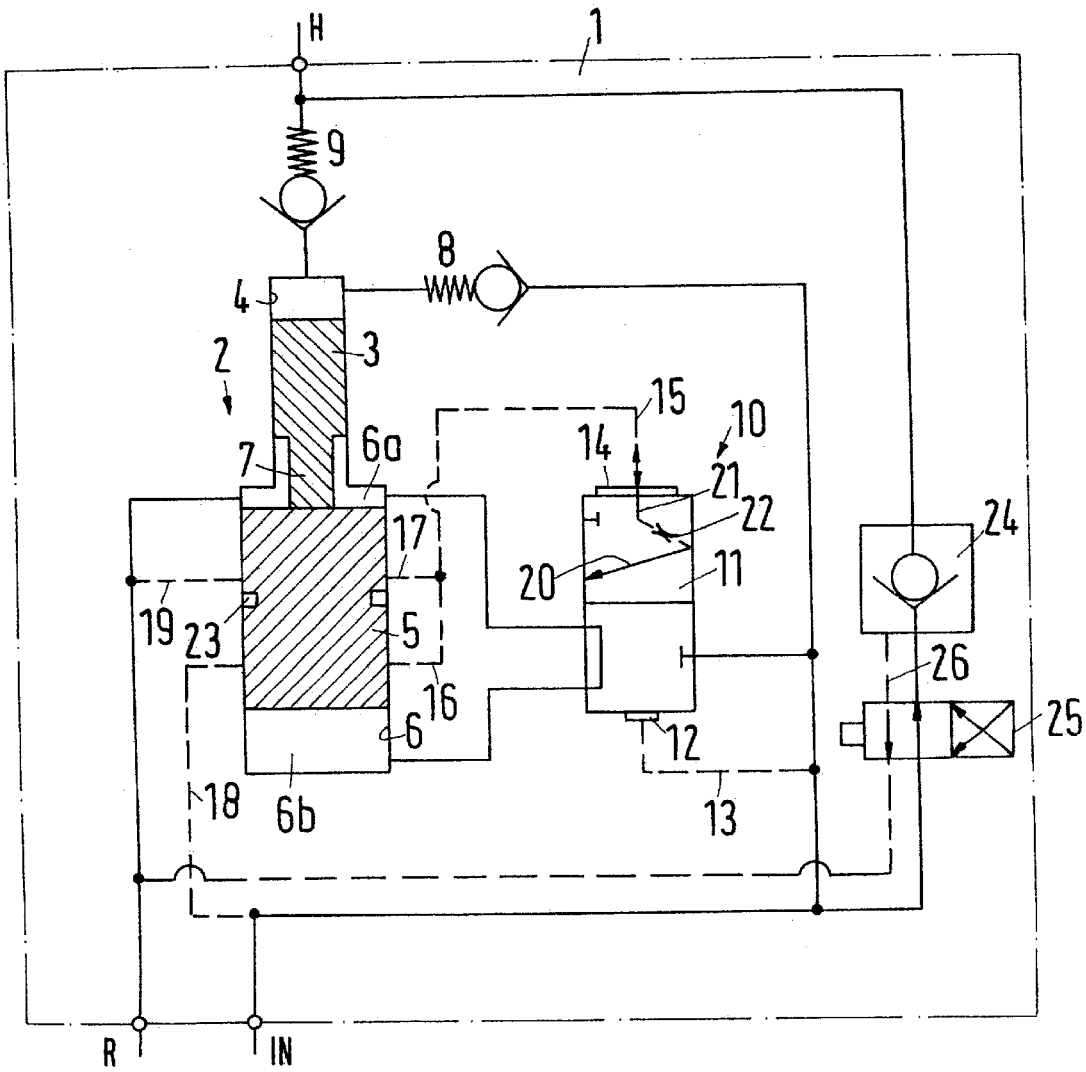
FIG. 1 is a schematic illustration of a first embodiment of a hydraulic pressure intensifier.

A pressure intensifier 1 includes a high-pressure connection H, a supply connection IN and a return connection R. Via the supply connection IN, hydraulic fluid is provided at a predetermined, lower pressure which for example comes from a pump, not shown in more detail. At the high-pressure connection H, a fluid is discharged at a higher pressure. The ratio of the pressures between the supply connection IN and the high-pressure connection H is determined by the transmission ratio of an intensifier piston assembly 2 comprising a high-pressure piston 3 in a high-pressure cylinder 4 and a low-pressure piston 5 in a low-pressure cylinder 6. The low-pressure piston 5 is connected to the high-pressure piston 3 via a connection 7, wherein this connection can at least be subjected to pushing.

The low-pressure piston 5 divides the low-pressure cylinder 6 into a first low-pressure chamber 6*a* which is adjacent to the high-pressure piston 3, and into a second low-pressure chamber 6*b* on the opposite side of the low-pressure piston.

The high-pressure cylinder 4 is connected via a non-return valve 8 to the supply connection IN, wherein the non-return valve 8 opens towards the high-pressure cylinder 4, and via a second non-return valve 9 to the high-pressure connection H, wherein the second non-return valve 9 opens towards the high-pressure connection H.

For control of the movement of the coupled high-pressure and low-pressure pistons, a switching valve 10 comprising a valve element 11 is provided. The valve element 11 can be constructed, for example, as a slide which on one end face is subjected to a pressure in a first control pressure chamber 12 which is connected by a first pilot line 13 to the supply connection IN and acts with a smaller pressure application area on the valve element 11 than the pressure in a second control pressure chamber 14 whose pressure application area on the valve element 11 is larger. This is shown schematically by the fact that the first control pressure chamber 12 has a smaller box than the second control pressure chamber 14.

The second control pressure chamber 14 is connected to a second pilot line 15 which includes a first branch 16 and a second branch 17, wherein both branches 16, 17 open out into the circumferential wall of the low-pressure cylinder 6.

At the same axial position at which the first branch 16 of the second pilot line 15 opens out, a supply channel 18 which is connected to the supply connection IN opens out. At the same axial position at which the second branch 17 of the second pilot line 15 opens out, a return channel 19 which is connected to the return connection R also opens out.

The valve element connects the two low-pressure chambers 6*a*, 6*b* to each other in a first position which is shown in FIG. 1. The first low-pressure chamber 6*a* is furthermore permanently connected to the return connection R. This position of the valve element 11 is determined by the fact that in the first control pressure chamber 12 the pressure at the input connection IN prevails, while the second control pressure chamber 14 is relieved of pressure, that is, at most the pressure at the return connection R prevails in it.

When the valve element 11 assumes its other position which is not shown in FIG. 1, then it connects the supply connection IN to the second low-pressure chamber 6*b* via a channel 20, while it blocks an exit from the first low-pressure chamber 6*a*.

From the channel 20 branches off a line 21 in which is arranged a stop plug 22. The line 21 opens out in the second control pressure chamber 14.

The low-pressure piston 5 comprises a circumferential groove 23 which, in one end position of the low-pressure piston 5, comes into alignment with the second branch 17 of the second pilot line 15 and the return channel 19. In the other end position of the low-pressure piston 5 the circumferential groove 23 comes into alignment with the first branch 16 of the second pilot line 15 and the supply channel 18. The circumferential groove 23 accordingly forms an auxiliary channel which, depending on the position of the low-pressure piston 5, makes a connection of the second pilot line 15 to the supply connection IN or to the return connection R.

The pressure intensifier 1 operates as follows:

Let it be assumed that the valve element 11 of the switching valve 10 is in the position shown in FIG. 1. The two low-pressure chambers 6*a*, 6*b* are connected and therefore relieved of pressure towards the return connection R. The fluid flowing in via the first non-return valve 8 from the supply connection IN builds up a certain pressure in the high-pressure cylinder 4 and pushes the high-pressure piston 3 and the low-pressure piston 5 connected thereto downwards, that is, in such a way that the volume of the high-pressure cylinder 4 increases.

In the region of the lower end position, the circumferential groove 23 connects the supply connection IN via the first branch 16 and the pilot line 15 to the second control pressure chamber 14, so that in the second control pressure chamber 14 the pressure at the supply connection IN builds up. As this pressure acts on the valve element 11 via a larger pressure application area than the equal pressure in the first control pressure chamber 12, the switching valve 10 is switched and the valve element 11 moves into its other position where it connects the supply connection IN to the second low-pressure chamber 6*b*. But in this position the supply connection IN is also connected to the second control pressure chamber 14 via the stop plug 22, so that even if leaks possibly occur the pressure in the second control pressure chamber 14 is maintained at the pressure at the supply connection IN. The stop plug 22 is in this case designed so as to be able to equalize leaks. If occasion arises it can also allow a slightly larger fluid stream.

The pressure in the second low-pressure chamber 6*b* pushes the low-pressure piston 5 and hence the high-pressure piston 3 upwards, decreasing the volume of the high-pressure cylinder 4 (the details of direction here refer to the drawings, but in reality the orientation of the pressure intensifier 1 in space is unimportant), so that in the high-pressure cylinder 4 is generated a pressure which is greater, by the ratio of the cross-sectional areas of low-pressure cylinder 6 and high-pressure cylinder 4, than the pressure at the supply connection IN. The fluid displaced in the process out of the high-pressure cylinder 4 is discharged via the second non-return valve 9 to the high-pressure connection H.

In the region of the upper end position of the low-pressure piston 5, the circumferential groove 23 comes into alignment with the return channel 19, on the one hand, and the second branch 17 of the second pilot line 15, on the other hand, and so makes a short circuit between the second control pressure chamber 14 and the return connection R. The pressure in the second control pressure chamber 14 then rapidly falls to the pressure at the return connection R, so that the pressure in the first control pressure chamber 12 is capable of moving the valve element 11 back into the position shown in FIG. 1 again. When the valve element 11 has arrived in this position, the cycle begins again. When the desired relief of pressure is effected, not enough fluid can continue flowing through the stop plug 22 to maintain the pressure in the second control pressure chamber.

The high-pressure connection H is further connected via a pilot-controlled non-return valve 24. The pilot-controlled non-return valve 24 is either connected via a switching valve 25 to the supply connection IN, wherein a control line 26 of the non-return valve 24 is connected to the return connection R, or the non-return valve is connected (after switching of the switching valve 25) to the return connection R, wherein the control line 26 is connected to the supply connection IN. The pressure at the supply connection IN is sufficient to open the non-return valve 24. Therefore, when the switching valve 25 is switched, then there is relief of pressure at the high-pressure connection H to the return connection R.

Figure 2:
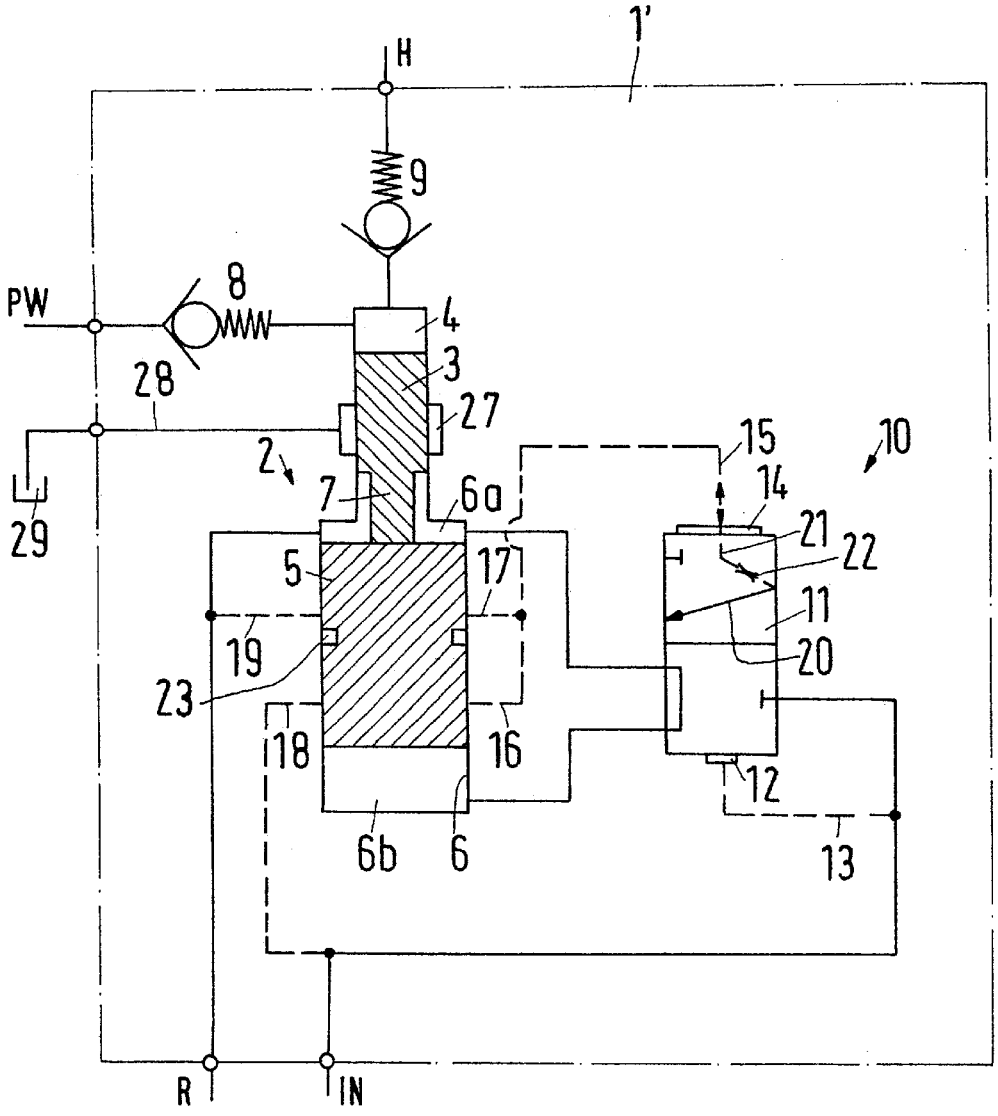
FIG. 2 is a schematic illustration of a second embodiment of a hydraulic pressure intensifier.

Control of the switching valve 10 exclusively by the low-pressure piston 5 is advantageous particularly if the pumped fluid in the high-pressure cylinder 4 is to be different from the driving fluid which moves in a circuit comprising the connections IN, R. A pressure intensifier 1' of this kind is shown in FIG. 2. Parts which correspond to those of FIG. 1 are marked with the same reference numbers.

By contrast with the embodiment of FIG. 1, a connection is now no longer provided from the supply connection IN to the high-pressure cylinder 4. The high-pressure cylinder 4 is instead connected via the first non-return valve 8 to its own pressure connection $P_W$ via which a fluid to be pumped, for example water, is delivered, while the driving fluid at the supply connection IN can be, for example, hydraulic oil. The only requirement is that the pressure at the pressure connection $P_W$ is sufficient to displace the high-pressure piston 3 downwards. In a similar way, the output of the high-pressure cylinder 4 is connected via the second non-return valve 9 to the high-pressure connection H, which, however, has no coupling with the supply connection IN or with the return connection R.

The high-pressure piston 3 is sealed off with a sealing assembly 27. From the sealing assembly 27 comes a leak line 28 which opens out into a tank 29. In the event that fluid pushes forward from one or the other side into the sealing assembly 27, it is conducted away via the leak line 28 into the tank 29, so that mixing of the fluids in the drive train, on the one hand, and in the high-pressure train, on the other hand, can be avoided.

In other respects the pressure intensifier 1' operates exactly like the pressure intensifier 1 as in FIG. 1. The valve element 11 of the switching valve 10 is switched and reliably held in its switched position by the pressure maintained by the stop plug 22, until the second pressure chamber 14 is relieved of pressure again.

The invention is not limited by the embodiments described above which are presented as examples only but can be modified in various ways within the scope of protection defined by the appended patent claims.

We claim:

1. A hydraulic pressure intensifier comprising a supply connection, a return connection, and a high-pressure connection, an intensifier piston assembly comprising a high-pressure cylinder and a high-pressure piston displaceable in the high-pressure cylinder, a low-pressure cylinder having a greater cross-section than the high-pressure cylinder and a low-pressure piston displaceable in the low-pressure cylinder, wherein the low-pressure piston is connected to the high-pressure piston and divides the low-pressure cylinder into a first low-pressure chamber on a side of the high-pressure piston and a second low-pressure chamber, a switching valve configured to act on the second low-pressure chamber with pressure from a pressure source or for relieving the second low-pressure chamber of pressure, wherein the switching valve comprises a valve element which in one direction of movement is subjected to a pressure in a first control pressure chamber having a pressure application area and in an opposite direction of movement is subjected to a pressure in a second control pressure chamber having a pressure application area which is larger than the pressure application area of the first control pressure chamber, wherein the low-pressure piston is configured to control pressure in the second control pressure chamber.

2. The pressure intensifier according to claim 1, wherein the second control pressure chamber is connected to a pilot line having first and second branches, wherein the first and second branches open out into the circumferential wall of the low-pressure cylinder at two positions axially remote from each other.

3. The pressure intensifier according to claim 2, wherein the low-pressure piston comprises an auxiliary channel which is in alignment with an opening of the first branch in one position of the low-pressure piston and is in alignment with an opening of the second branch when the low-pressure piston is in another position.

4. The pressure intensifier according to claim 3, wherein the auxiliary channel is a circumferential groove on the low-pressure piston.

5. The pressure intensifier according to claim 3, further comprising a supply channel connected to the supply connection, wherein the supply channel opens out into the circumferential wall of the low-pressure cylinder at an axial position equal to the opening of the first branch, and a return channel connected to the return connection, wherein the return channel opens out into the circumferential wall of the low-pressure cylinder at an axial position equal to the opening of the second branch.

6. The pressure intensifier according to claim 1, further comprising a stop plug arranged between the second control pressure chamber and the supply connection.

7. The pressure intensifier according to claim 6, wherein the stop plug is arranged in a line which can be shut off.

8. The pressure intensifier according to claim 7, wherein the valve element is configured to control the line which can be shut off.

9. The pressure intensifier according to claim 6, wherein the stop plug is arranged in the valve element.

10. The pressure intensifier according to claim 6, wherein the stop plug branches off from a channel which connects the supply connection to the second low-pressure chamber when the valve element is in a position effected by the pressure in the second control pressure chamber.

11. The pressure intensifier according to claim 6, wherein the high-pressure connection is connected to the return connection via a pilot-controlled non-return valve.

* * * * *

UNITED STATES PATENT AND TRADEMARK OFFICE

CERTIFICATE OF CORRECTION

PATENT NO. : 6,776,080 B2
APPLICATION NO. : 10/305324
DATED : August 17, 2004
INVENTOR(S) : Leif Hansen et al.

It is certified that error appears in the above-identified patent and that said Letters Patent is hereby corrected as shown below:

Title page; item [75] Inventors: should read as follows: Leif Hansen, Sønderborg, (DK); Peter J.M. Clausen, Nordborg, (DK); Christen Espersen, Augustenborg (DK); Jan Petersen, Egernsund (DK)

Signed and Sealed this
Nineteenth Day of June, 2012

David J. Kappos
*Director of the United States Patent and Trademark Office*